US005911271A

United States Patent [19]

Fierle et al.

[11] Patent Number: 5,911,271

[45] Date of Patent: Jun. 15, 1999

[54] FLOATING BYPASS SEAL FOR ROTARY REGENERATIVE HEAT EXCHANGERS

[75] Inventors: Kurt M. Fierle; Robin B. Rhodes, both of Wellsville, N.Y.

[73] Assignee: ABB Air Preheater, Inc., Wellsville, N.Y.

[21] Appl. No.: 09/140,883

[22] Filed: Aug. 27, 1998

[51] Int. Cl.[6] ..... F23L 15/02

[52] U.S. Cl. ..... 165/9; 165/8; 165/DIG. 26

[58] Field of Search ..... 165/9, 10, 8, DIG. 21, 165/DIG. 22, DIG. 26

[56] References Cited

U.S. PATENT DOCUMENTS

| | | | |
|---|---|---|---|
| 3,157,226 | 11/1964 | Atwood | 165/9 |
| 3,216,486 | 11/1965 | Hall et al. | 165/9 |
| 3,545,532 | 12/1970 | Waitkus | 165/9 |
| 3,710,851 | 1/1973 | Finnemore | 165/9 |
| 3,818,978 | 6/1974 | Finnemore | 165/9 |
| 4,044,822 | 8/1977 | Stockman | 165/9 |
| 5,048,595 | 9/1991 | Harder | 165/9 |
| 5,540,274 | 7/1996 | Slocum et al. | 165/9 |
| 5,664,621 | 9/1997 | Brophy | 165/8 |

*Primary Examiner*—Ira S. Lazarus
*Assistant Examiner*—Christopher Atkinson
*Attorney, Agent, or Firm*—Alix, Yale & Ristas, LLP

[57] ABSTRACT

The gas flow bypass around the heating elements in a regenerative air preheater is reduced by the use of floating bypass seals which are placed in the rotor compartments between stacked heating elements. The seals comprise a frame with an open center with the peripheral frame portion bridging the gaps between the heating elements and the sides of the compartments. The seals may be adjustable and may include a deformable edge seal to actually contact and seal against the sides.

13 Claims, 6 Drawing Sheets

FLOATING BYPASS SEAL FOR ROTARY REGENERATIVE HEAT EXCHANGERS

BACKGROUND OF THE INVENTION

The present invention relates to means for reducing or eliminating the internal bypassing of gas streams around the heating elements in rotary regenerative heat exchangers and particularly relates to the internal bypassing of air and flue gas streams around the heating elements in an air preheater.

In a rotary regenerative air preheater, the rotor is divided up into pie-shaped sectors, which are in turn subdivided into rotor compartments. Each rotor compartment is designed to accommodate one or more assemblies of heating elements comprising basket-like containers and heat transfer surfaces therein. Because of fabrication tolerances and/or the distortion of the rotor structure associated with extended operation under varying thermal conditions, it is usually necessary to design the heating elements to allow a clearance around each basket so as to avoid interference at installation.

When fabrication tolerances, rotor distortion and/or design clearances result in excessive gaps ("bypass gaps") between the sides of the basket and the corresponding side wall of the rotor compartment or adjacent basket, a portion of the air and gas streams will flow through the gaps thereby bypassing the heat transfer surfaces and thereby resulting in a loss in heat transfer efficiency.

Bypass gaps have been addressed in the past by a practice known as "tabbing" which entailed the welding of bypass strips over gaps deemed large enough to close, or with resilient sealing devices installed in gap areas large enough to accept them. Both of these approaches are costly in field labor expense and/or material. Generally, every layer of heating elements needs to be tabbed or sealed individually.

SUMMARY OF THE INVENTION

The present invention provides a unique means to reduce or eliminate air and gas flow bypass around the heat transfer surfaces in rotary regenerative heat exchangers. The invention involves the use of floating seals placed in the rotor compartments adjacent the ends of the heating elements and around the periphery of the heating elements ends. The floating seals are sized to fit each compartment with minimal clearance whereby the seals bridge the gaps between the heating elements and the sides of the compartments. The seals may be adjustable to accommodate various sized compartments. A modification includes deformable edge seals attached to two or more sides of the floating seals whereby the edge seals are deformed to conform to the walls when the floating seals are pressed into position.

DESCRIPTION OF THE PREFERRED EMBODIMENTS

Figure 1:
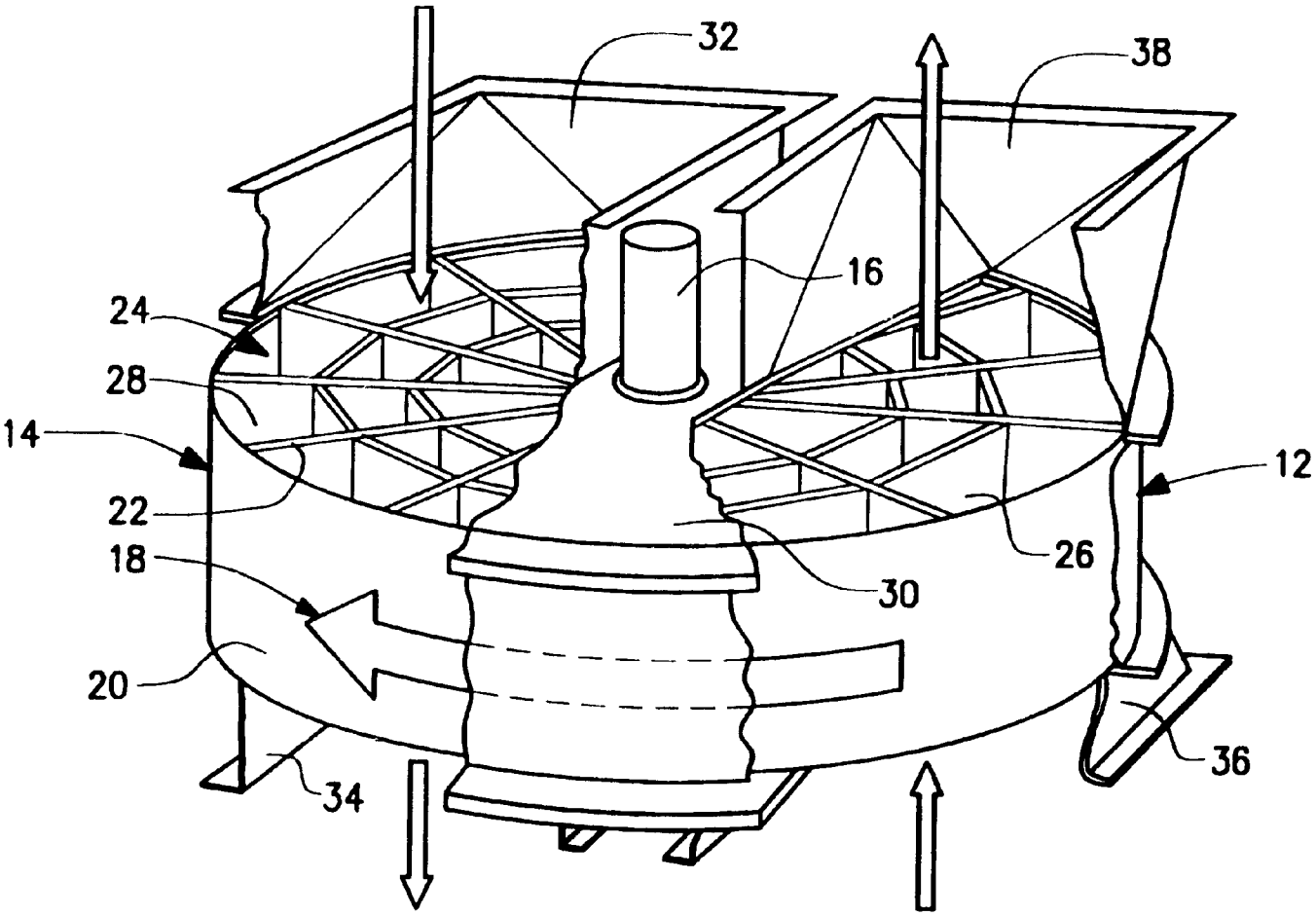
Fig. 1 (Prior Art)
FIG. 1 is a generalized perspective view of a typical rotary regenerative air preheater showing the rotor sectors and compartments.

In the description of the present invention, rotary regenerative air preheaters which are used for transferring heat from flue gas to combustion air will be used as the example. However, it is to be understood that the invention is applicable to any rotary or stationary regenerative heat exchangers. FIG. 1 of the drawing illustrates a partially cut-away perspective view of such a conventional air preheater showing a housing 12 in which a rotor 14 is mounted on drive shaft or post 16 for rotation as indicated by the arrow 18. The rotor has an outer shell 20 and a plurality of radially extending diaphragms 22 dividing the rotor into the pie-shaped sectors 24. The tangential plates 26 divide each sector 24 into the generally trapezoidally-shaped compartments 28. The outermost compartments usually have a curved outer end defined by the rotor shell 20. Although not shown in this FIG. 1, each compartment contains a plurality of stacked heating elements. The housing of the air preheater is divided by the plate 30 into a flue gas side and an air side. A corresponding center section is located on the bottom of the unit. The hot flue gases enter the air preheater through the inlet duct 32, flow axially through the rotor where heat is transferred to the heat transfer surface and then exit through the gas outlet duct 34. The countercurrent flowing air enters through the air inlet duct 36, flows through the rotor 14 and picks up heat and then exits through the air outlet duct 38.

Figure 2:
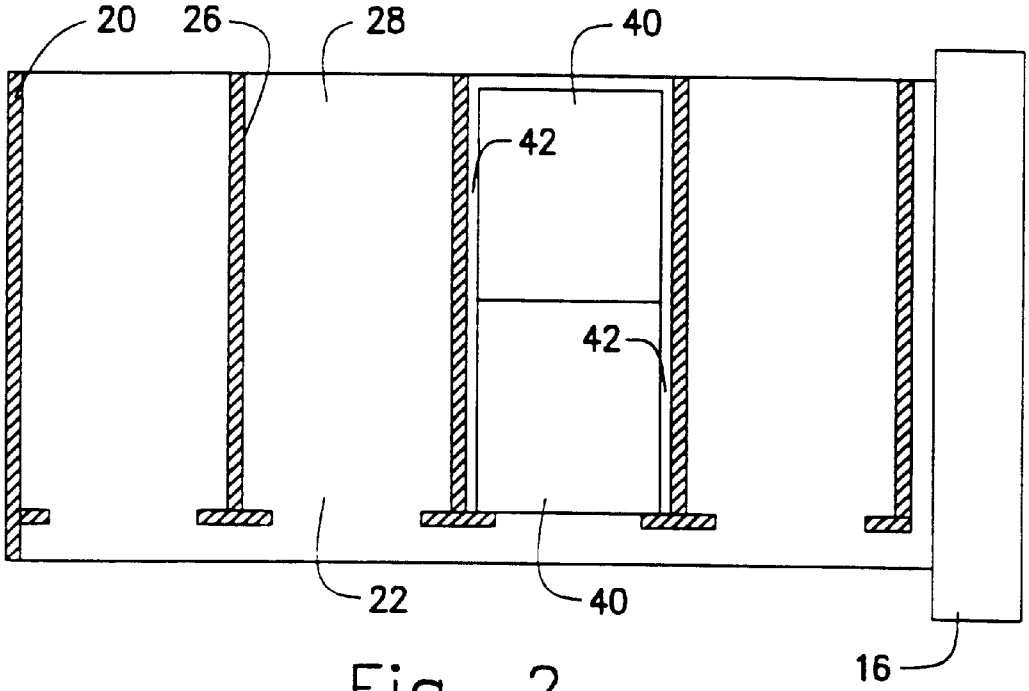
Fig. 2 (Prior Art)
FIG. 2 is a cross section elevation through one sector of a portion of a rotor illustrating conventional heating elements stacked vertically in one of the compartments and showing the bypass gap.

FIG. 2 is an elevation cross section of a portion of the rotor of FIG. 1 basically showing one sector with the radial diaphragm 22 extending between the rotor post 16 and the rotor shell 20. The tangentially extending plates 26 together with the diaphragms 22 form the compartments 28. This FIG. 2 illustrates two heating elements 40 stacked in one of the compartments 28. However, it will be understood that there will be heating elements in each of the compartments and that there may be more or less than two heating elements stacked in each compartment. This FIG. 2 illustrates the tangential gaps 42 between the elements and the tangential plates 26.

Figure 3:
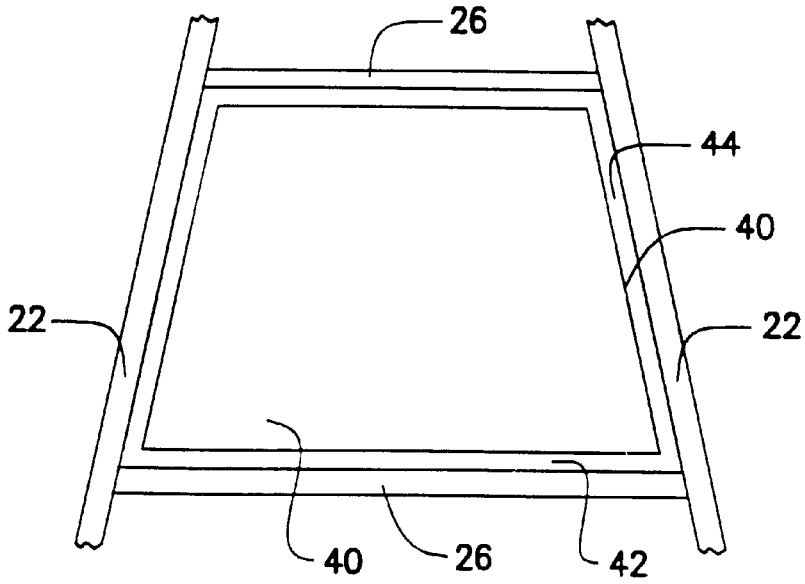
Fig. 3 (Prior Art)
FIG. 3 is a plan view of a rotor compartment of the prior art containing a heating element and illustrating the bypass gaps.

In order to further illustrate the problem with prior designs, FIG. 3 is a plan view showing a heating element 40 in a compartment 28 bounded by the diaphragms 22 and the tangential plates 26. As can be seen, there are radial gaps 44 between the sides of the heating element 40 and the diaphragms 22 and the tangential gaps 42 between the inner and outer ends of the heating element 40 and the tangential plates 26 as also shown in FIG. 2.

Figure 10:
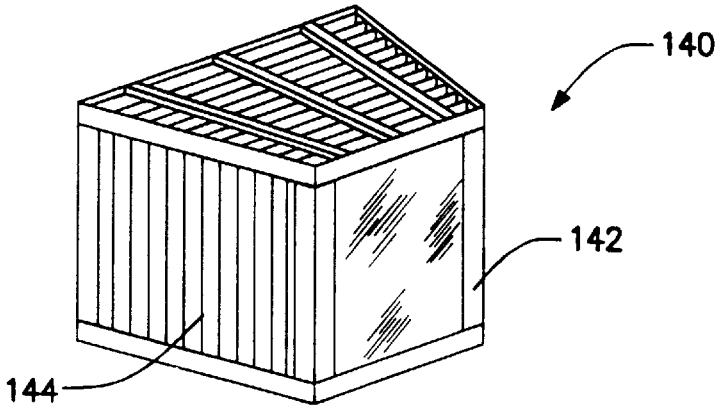
Fig. 10 (Prior Art)
FIGS. 10, 11 and 12 show three types of heating elements.
Figure 11:
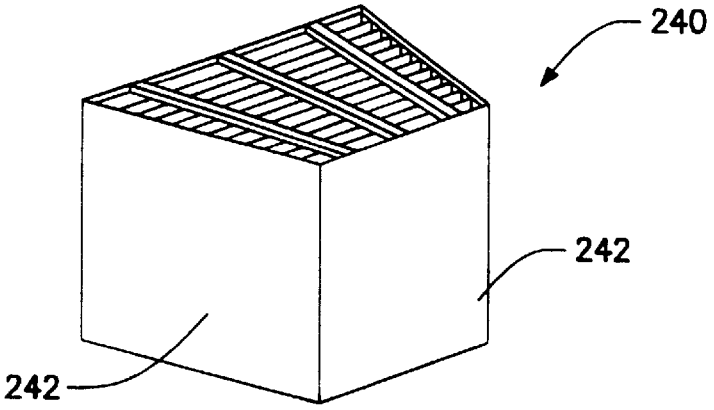
Fig. 11 (Prior Art)
Figure 12:
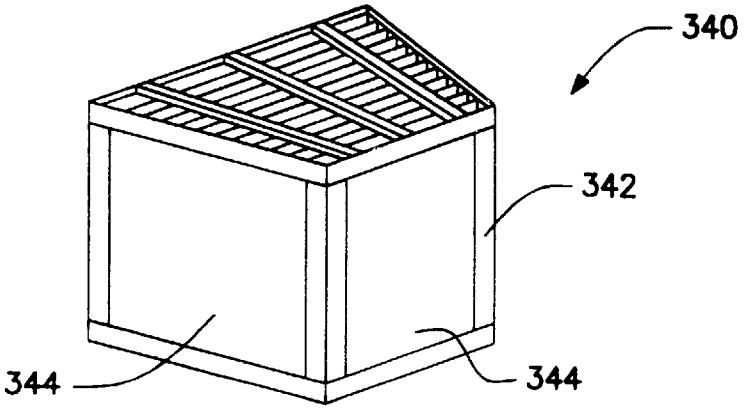
Fig. 12 (Prior Art)

There are basically two types of conventional heating elements 40. One type is commonly referred to as a picture frame style basket 140 having only a frame 142 around each of its four vertical faces as shown in FIG. 10. The heat transfer surface consisting of a large number of individual plates 144 parallel to the inner and outer ends is installed in the basket. With this type of basket, the air and gas can escape through the sides of the heating element into the bypass gap either above or below any tabbing which may be installed. The other general type of heating element is typically referred to as a full wrapper basket 240 with each of the four vertical faces being closed by a continuous plate 242 wrapped around the basket as shown in FIG. 11. Since the sides and ends are all closed, there can be no escape of air or gas from the inside to the outside of each individual heating element. Another type of closed heating element 340 is a hybrid of the picture frame type and the full wrapper type. It has a picture frame basket 342 but the four vertical faces have plates 344 attached to the frame to close off the sides as shown in FIG. 12. With any of these types of heating elements, the bypass gap is a problem. With respect to the present invention, baskets of any style will work, however, use of the present invention with baskets of the closed type such as the full wrapper basket of FIG. 11 or the picture frame type with side plates of FIG. 12 will produce preferential results.

Figure 4:
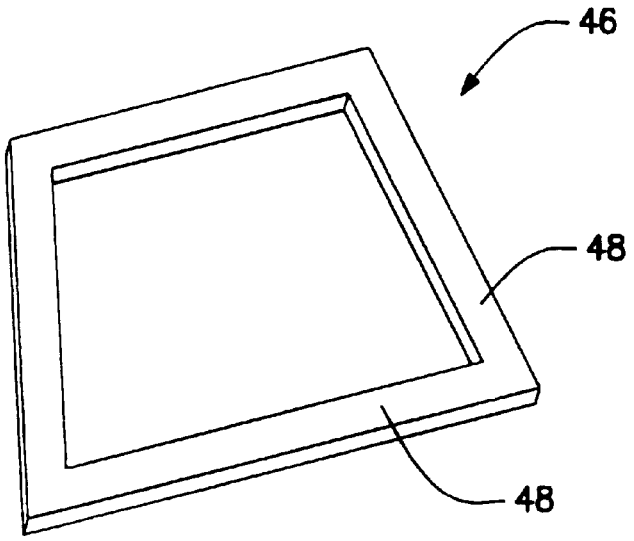
FIG. 4 is a perspective view of one of the floating seals of the present invention.

FIG. 4 shows a floating bypass seal 46 in accordance with the present invention. This seal 46 is generally a trapezoidal shaped frame sized to fit a given rotor compartment 28 with minimal clearance. There are various sized seals to fit the various sized compartments. Also, the seals for the outermost compartments may have a curved outer end to conform to the curved rotor shell 20. The sizes of the floating bypass seals are selected for the various sized compartments such that they are capable of being inserted into the compartments with any clearance being minimized taking into consideration the tolerances on the compartment sizes and any expected distortion. The width of the sides 48 of the seals 46 is selected such that there will be continuous engagement with the upper or lower perimeter of any given heating element 40. The thickness of the seals 46 is selected to be substantial enough for handling, for installation into the compartments and for withstanding any loading induced by the adjacent heating elements.

Figure 5:
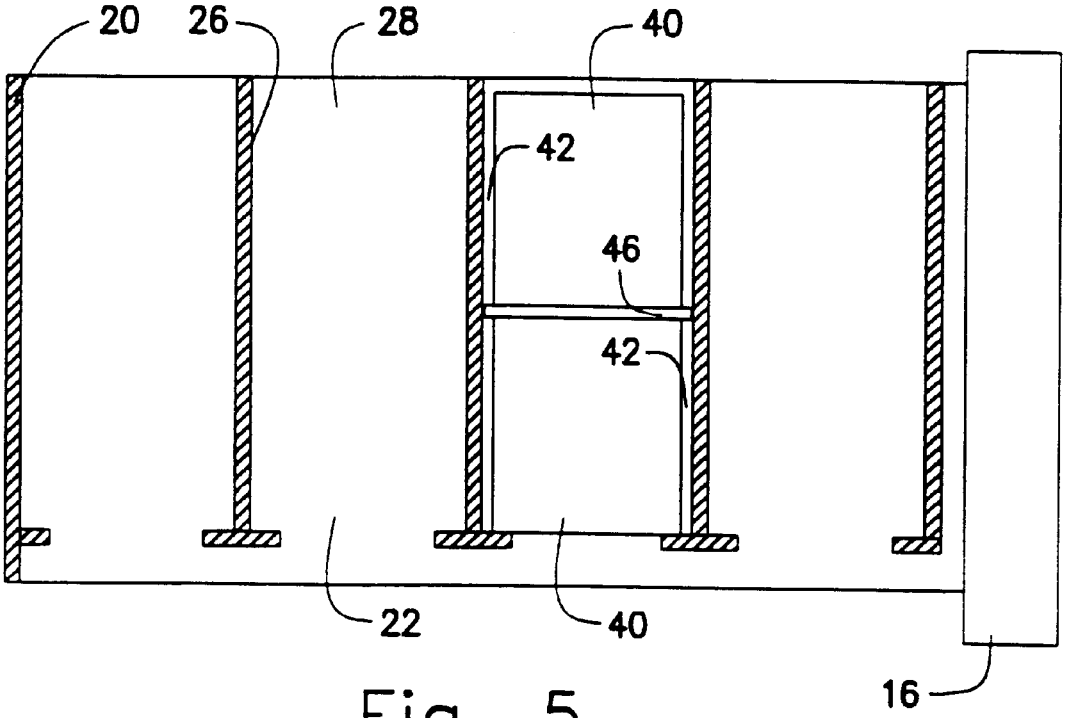
FIG. 5 is a partial elevation cross section of a rotor similar to FIG. 2 but illustrating a compartment with the floating seal of the present invention in position between the heating elements.
Figure 6:
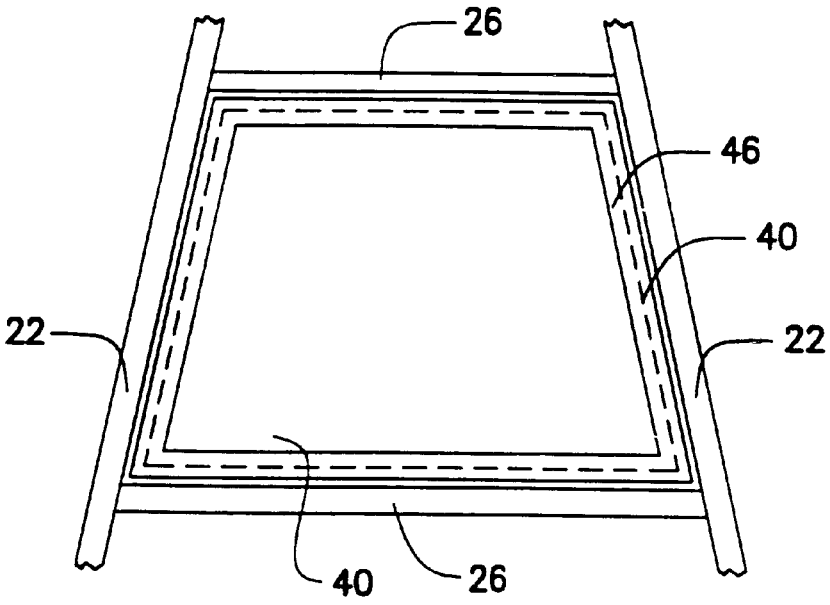
FIG. 6 is a partial plan view of a rotor illustrating a compartment containing a heating element and a floating seal.

FIG. 5 is an elevation cross section of a portion of a rotor illustrating the floating bypass seal 46 of the present invention located in position in a compartment between the heating elements 40. As can be seen, the floating bypass seal essentially extends out to the tangential plates 26 to close off the gap 42. FIG. 6 is another showing of the floating bypass seal 46 in position overlying a heating element 40. The periphery of the heating element 40 is shown in dotted line below the seal 40. It can be seen that the seal extends out to the sides of the compartment with minimal clearance and that the seal overlaps the heating element 40 to form a flow restriction and essentially close the gap. As can be seen in the FIG. 5, the floating bypass seal 46 is sandwiched between the two heating elements 40. Therefore, the seal, which is typically free floating, cannot be blown out of position such as when soot blowing pressures are applied. During installation of the seal, it may be advantageous to at least temporarily fasten the seal in position in the compartment. This can be done by welding such as tack welding along at least one side. This may facilitate the assembly even though the tack welds may later break due to the forces created such as by thermal expansion.

Figure 7:
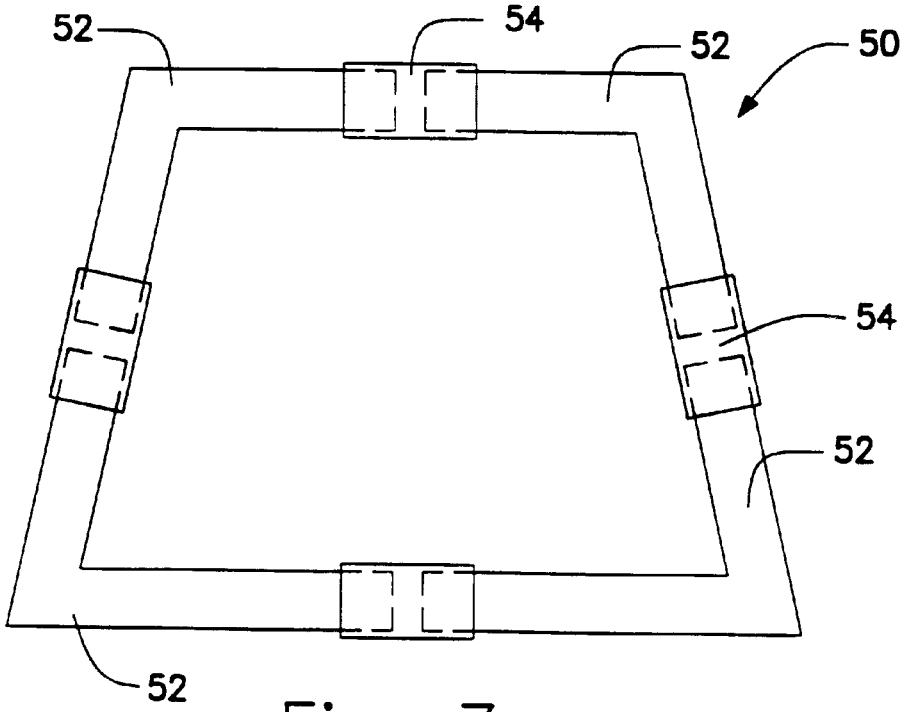
FIG. 7 shows an adjustable modification of the floating seal.

Since some air preheaters may have corresponding compartments 28 in various sectors 24 which vary in size, either due to manufacturing tolerance or thermal deformations, FIG. 7 shows a modified floating bypass seal 50 which is adjustable. This floating bypass seal is subdivided into segments identified as 52 which are connected to each other by the sliding coupling means 54. The coupling means 54 which are illustrated are merely heavy sheet metal bent around the joints between the segments to hold the segments together while permitting the segments to slide within the coupling means. However, other forms of coupling means could also be used in the present invention. For example, the ends of the segments could have openings into which a coupling bar is slidably inserted thereby bridging the joints. After assembly of the four segments 52 with the coupling means 54, the floating bypass seal 50 is installed in a compartment 28 and then adjusted outward so that the segments engage the radial and tangential plates or, in the case of the outermost compartment, engage the rotor shell. This assures that the clearances between the floating bypass seals and the walls of the compartments are always minimal.

Figure 8:
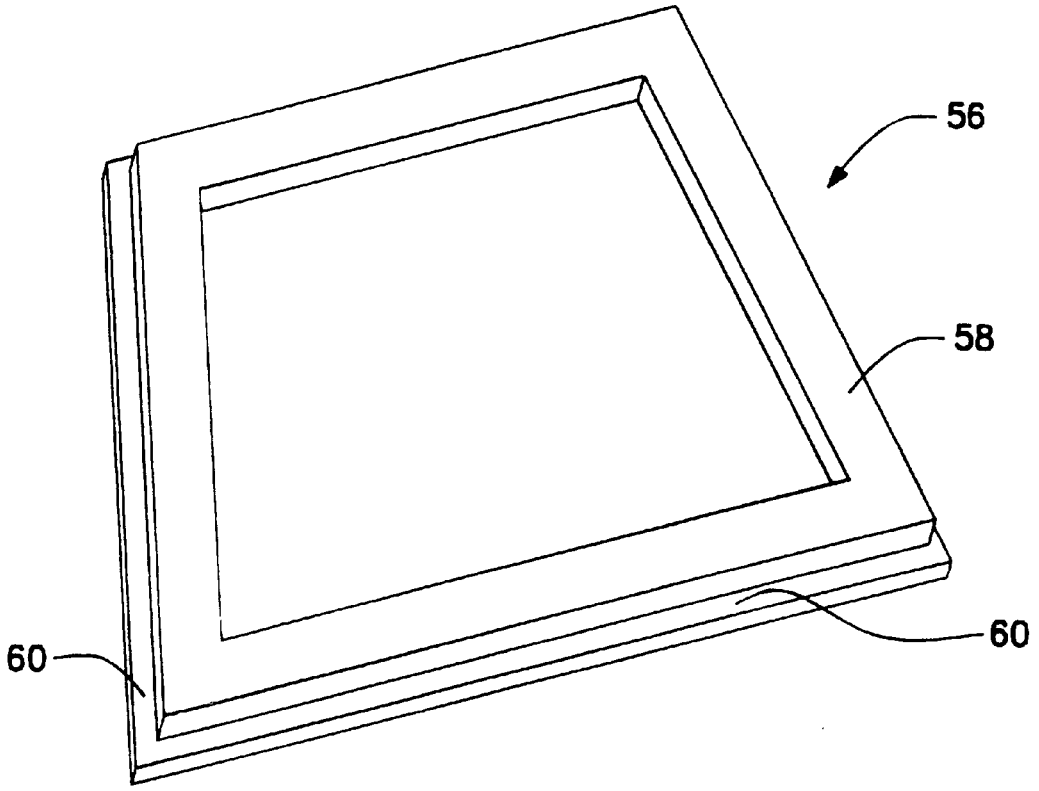
FIG. 8 is a side view of a modified floating seal with deformable edge seals.
Figure 9:
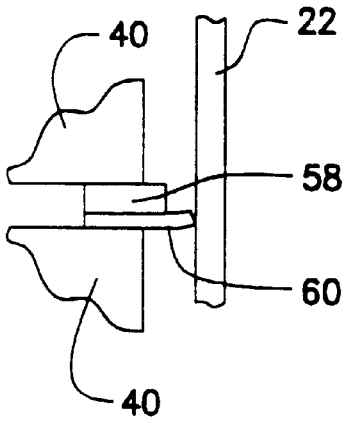
FIG. 9 is a side view illustrating the modified floating seal of FIG. 8 in a compartment with the edge seals deformed.

Another embodiment of the invention is shown in FIGS. 8 and 9. In this embodiment, the floating bypass seal, now identified as 56, consists of a base frame 58 which is sized to fit a rotor compartment with a slightly increased but still small clearance. Attached to the base frame 58 is a deformable edge seal 60 which may be on all four sides as shown in FIG. 8 or may only be on fewer than four sides. This deformable edge seal may be attached by any suitable means such as welding and may be formed from any light gauge metal strip which is capable of being deformed to conform to the shape of the compartment walls. For installation, this modified floating bypass seal 56 is positioned in the intended compartment, usually at an angle, and then pressed down into position in engagement with the top of a heating element. In the process of pressing the seal into position, the edge seal 60 is deformed to essentially form a continuous engagement between the seal and the compartment wall as shown in FIG. 9.

We claim:

1. A rotor for a rotary regenerative heat exchanger comprising:

a. a rotor post;

b. an outer shell;

c. diaphragm plates dividing said rotor into a plurality of pie-shaped sectors;

d. a plurality of tangential plates in each of said sectors dividing said sectors into a plurality of compartments;

e. a plurality of heating elements stacked in each of said compartments, wherein gaps may exist around said heating elements between said heating elements and said diaphragm plates and said tangential plates; and f. floating bypass sealing means adjacent to at least one of said heating elements to prevent gases from bypassing around said heating element through said gaps, said floating bypass sealing means comprising a peripheral band having an outside perimeter and an open center, said outside perimeter shaped to fit into said compartment closely adjacent to and forming a seal with said diaphragm plates and said tangential plates and said peripheral band having a width selected to bridge said gap between said heating elements and said diaphragm plates and said tangential plates and at least partially overlap said heating elements thereby preventing gases from bypassing said heating elements through said gaps.

2. A rotor as recited in claim 1 wherein said plurality of heating elements have closed sides.

3. A rotor as recited in claim 2 wherein said plurality of heating elements are of a full wrapper type.

4. A rotor as recited in claim 2 wherein said plurality of heating elements are of a picture frame type with side plates.

5. A rotor as recited in claim 1 wherein said floating bypass sealing means is subdivided into segments and wherein said segments are connected to each other by adjustable coupling means whereby the size of said floating bypass seal is adjustable.

6. A rotor as recited in claim 1 wherein said floating bypass sealing means comprises a base frame and a deformable edge seal around the periphery thereof for engagement with said diaphragm plates and said tangential plates.

7. A rotor as recited in claim 1 wherein said floating bypass sealing means is sandwiched between two of said stacking heating elements.

8. A rotor as recited in claim 2 wherein said floating bypass sealing means is sandwiched between two of said stacking heating elements.

9. A rotor as recited in claim 3 wherein said floating bypass sealing means is sandwiched between two of said stacking heating elements.

10. A rotor as recited in claim 4 wherein said floating bypass sealing means is sandwiched between two of said stacking heating elements.

11. A rotor as recited in claim 5 wherein said floating bypass sealing means is sandwiched between two of said stacking heating elements.

12. A rotor as recited in claim 6 wherein said floating bypass sealing means is sandwiched between two of said stacking heating elements.

13. A rotor as recited in claim 1 wherein said floating bypass sealing means is welded in said compartment during installation.

* * * * *